US010126012B2

(12) United States Patent
Ikawa et al.

(10) Patent No.: US 10,126,012 B2
(45) Date of Patent: Nov. 13, 2018

(54) AIR CONDITIONER

(71) Applicant: DAIKIN INDUSTRIES, LTD., Osaka-Shi, Osaka (JP)

(72) Inventors: Shinsuke Ikawa, Osaka (JP); Akio Tasaka, Osaka (JP); Takashige Mori, Osaka (JP); Tatsuya Yamashita, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/522,849

(22) PCT Filed: Sep. 29, 2015

(86) PCT No.: PCT/JP2015/077616
§ 371 (c)(1),
(2) Date: Apr. 28, 2017

(87) PCT Pub. No.: WO2016/067819
PCT Pub. Date: May 6, 2016

(65) Prior Publication Data

US 2017/0321940 A1 Nov. 9, 2017

(30) Foreign Application Priority Data

Oct. 31, 2014 (JP) ..... 2014-223396

(51) Int. Cl.
*F25B 13/00* (2006.01)
*F24F 11/89* (2018.01)
(Continued)

(52) U.S. Cl.
CPC ..... *F24F 11/89* (2018.01); *F24F 1/0007* (2013.01); *F24F 11/36* (2018.01); *F24F 11/72* (2018.01);
(Continued)

(58) Field of Classification Search
CPC ..... F25B 49/005; F25B 49/02; F25B 1/00; F24F 11/02; F24F 1/0007; F24F 1/0014
See application file for complete search history.

(56) References Cited

U.S. PATENT DOCUMENTS

2002/0178738 A1* 12/2002 Taira ..... F25B 49/005 62/129
2009/0199583 A1* 8/2009 Jeon ..... F24F 1/0011 62/259.1
2013/0098576 A1 4/2013 Fujitaka et al.

FOREIGN PATENT DOCUMENTS

JP 8-178397 A 7/1996
JP 8-200904 A 8/1996
(Continued)

OTHER PUBLICATIONS

International Search Report, issued in PCT/JP2015/077616, PCT/ISA/210, dated Dec. 22, 2015.
(Continued)

*Primary Examiner* — Emmanuel Duke
(74) *Attorney, Agent, or Firm* — Birch, Stewart, Kolasch & Birch, LLP

(57) ABSTRACT

An air conditioner which is able to prevent leaked refrigerant gas from disadvantageously stagnating at a part of a room space when leakage of refrigerant gas occurs in an indoor unit is provided.

An air conditioner of the present invention includes an indoor unit having an upper outlet port and a lower outlet port and uses flammable refrigerant, the air conditioner including: a shutter provided at the lower outlet port and is configured to switch between a blowout capable state in which wind is blown out and a blowout incapable state in which no wind is blown out; a refrigerant gas sensor provided in the indoor unit, and a controlling unit configured to control the shutter. In a driving state in which the lower
(Continued)

outlet port is in the blowout incapable state, when the refrigerant gas sensor detects the refrigerant gas, the controlling unit switches the lower outlet port from the blowout incapable state to the blowout capable state.

5 Claims, 7 Drawing Sheets

(51) Int. Cl.

| | |
|---|---|
| ***F25B 1/00*** | (2006.01) |
| ***F25B 49/02*** | (2006.01) |
| ***F25B 49/00*** | (2006.01) |
| ***F24F 1/00*** | (2011.01) |
| ***F24F 11/79*** | (2018.01) |
| ***F24F 11/36*** | (2018.01) |
| ***F24F 11/72*** | (2018.01) |
| ***F24F 11/74*** | (2018.01) |

(52) U.S. Cl.
CPC ..... *F24F 11/74* (2018.01); *F24F 11/79* (2018.01); *F25B 1/00* (2013.01); *F25B 49/005* (2013.01); *F25B 49/02* (2013.01)

(56) References Cited

FOREIGN PATENT DOCUMENTS

| | | | | | |
|---|---|---|---|---|---|
| JP | 08200904 | | * | 8/1996 | |
| JP | 08200904 | A | * | 8/1996 | |
| JP | 9-324928 | A | | 12/1997 | |
| JP | 2002-5548 | A | | 1/2002 | |
| JP | 2002-98393 | A | | 4/2002 | |
| JP | 2003-130385 | A | | 5/2003 | |
| JP | 2011-127847 | A | | 6/2011 | |
| JP | 2012-13348 | A | | 1/2012 | |
| JP | 2013-64524 | A | | 4/2013 | |
| JP | 2014-92317 | A | | 5/2014 | |
| JP | 2015094566 | A | * | 5/2015 | |
| WO | WO2011136271 | A1 | * | 11/2011 | ..... F24F 1/0014 |
| WO | WO 2012/001847 | A1 | | 1/2012 | |

OTHER PUBLICATIONS

The Decision to Grant a Patent has been received for JP 2014-223396 dated Apr. 14, 2016.
Extended European Search Report dated Jun. 21, 2018 in corresponding European Patent Application No. 15855956.7.

* cited by examiner

AIR CONDITIONER

TECHNICAL FIELD

The present invention relates to an air conditioner using flammable refrigerant.

An air conditioner using flammable refrigerant, to which a refrigerant gas sensor is attached to an indoor unit of the air conditioner, has been known.

CITATION LIST

Patent Literature

[Patent Literature 1] Japanese Unexamined Patent Publication No. 2012-13348

SUMMARY OF INVENTION

Technical Problem

There is an indoor unit of an air conditioner, which has an inlet port and plural outlet ports. Air sucked through the inlet port is blown out to the room through the outlet ports. Such an indoor unit may be driven in a state that at least one of the outlet ports is closed (i.e., the aperture area of the passage toward the outlet port is restricted to be small). In this case, air is blown out only through the remaining outlet port which is not closed. For example, an air conditioner having an upper outlet port formed in the vicinity of the upper end of the indoor unit and a lower outlet port formed in the vicinity of the lower end of the indoor unit may be driven in a state that the lower outlet port is closed. In this case, air is blown out only through the upper outlet port which is not closed. When leakage of refrigerant gas occurs in the indoor unit which is driven in a state that at least one of the outlet ports is closed, the leaked refrigerant gas disadvantageously stagnates locally at a part of the room space.

An object of the present invention is to provide an air conditioner which is able to prevent leaked refrigerant gas from disadvantageously stagnating locally at a part of a room space when leakage of refrigerant gas occurs in an indoor unit.

Solution to Problem

According to the first aspect of the invention, an air conditioner includes an indoor unit having plural outlet ports and uses flammable refrigerant, the air conditioner comprising: an adjusting mechanism which is provided on at least one of passages toward the respective outlet ports and is configured to adjust an aperture area of the corresponding passage; a refrigerant gas sensor provided in the indoor unit; and a controlling unit configured to control the adjusting mechanism, in a driving state in which an aperture area of a passage toward at least one of the outlet ports is restricted to be small, when the refrigerant gas sensor detects refrigerant gas, the controlling unit increasing the aperture area of the passage toward one or more of the at least one of the outlet ports.

In this air conditioner, when leakage of refrigerant gas in the indoor unit is detected while the air conditioner is driven in the state in which the aperture area of the passage toward at least one of the outlet ports is restricted to be small, the aperture area of the passage toward one or more of the at least one of the outlet port is enlarged. It is therefore possible to prevent the leaked refrigerant gas from locally stagnating at a part of the room space.

According to the second aspect of the invention, the air conditioner of the first aspect is arranged such that the controlling unit increases a wind flow rate at an outlet port other than the one or more of the at least one of the outlet ports, when the refrigerant gas sensor detects the refrigerant gas.

In this air conditioner, when leakage of refrigerant gas in the indoor unit is detected while the air conditioner is driven in the state in which the aperture area of the passage toward at least one of the outlet ports is restricted to be small, the wind flow rate at an outlet port other than one or more of the at least one of the outlet ports is increased. It is therefore possible to prevent the leaked refrigerant gas from locally stagnating at a part of the room space.

According to the third aspect of the invention, the air conditioner of the first or second aspect is arranged such that the controlling unit changes a wind direction at an outlet port other than the one or more of the at least one of the outlet ports downward, when the refrigerant gas sensor detects the refrigerant gas.

In this air conditioner, when leakage of refrigerant gas in the indoor unit is detected while the air conditioner is driven in the state in which the aperture area of the passage toward at least one of the outlet ports is restricted to be small, the wind direction at an outlet port other than the at least one outlet port is changed downward. It is therefore possible to prevent the leaked refrigerant gas from locally stagnating at around the floor of the room space.

According to the fourth aspect of the invention, the air conditioner of anyone of the first to third aspects is arranged such that the outlet ports include an upper outlet port provided at an upper end portion of a casing and a lower outlet port provided below the upper end portion, and in the driving state in which the aperture area of a passage toward the lower outlet port is restricted to be small, when the refrigerant gas sensor detects refrigerant gas, the controlling unit increases the aperture area of the passage toward the lower outlet port.

In this air conditioner, when leakage of refrigerant gas in the indoor unit is detected while the air conditioner is driven in the state in which the aperture area of the passage toward the lower outlet port out of the upper outlet port and the lower outlet port is restricted to be small, the aperture area of the passage toward the lower outlet port is enlarged. It is therefore possible to prevent the leaked refrigerant gas from locally stagnating at around the floor of the room space.

According to the fifth aspect of the invention, the air conditioner of any one of the first to fourth aspects is arranged such that the indoor unit is a floor-mounted indoor unit.

This air conditioner includes the floor-mounted indoor unit which is capable of preventing leaked refrigerant gas from locally stagnating at around the floor of the room space.

Advantageous Effects of Invention

As described hereinabove, the present invention brings about the following effects.

According to the first aspect of the invention, when leakage of refrigerant gas in the indoor unit is detected while the air conditioner is driven in the state in which the aperture area of the passage toward at least one of the outlet ports is restricted to be small, the aperture area of the passage toward one or more of the at least one of the outlet port is enlarged. It is therefore possible to prevent the leaked refrigerant gas from locally stagnating at a part of the room space.

According to the second aspect of the invention, when leakage of refrigerant gas in the indoor unit is detected while the air conditioner is driven in the state in which the aperture area of the passage toward at least one of the outlet ports is restricted to be small, the wind flow rate at an outlet port other than one or more of the at least one of the outlet ports is increased. It is therefore possible to prevent the leaked refrigerant gas from locally stagnating at a part of the room space.

According to the third aspect of the invention, when leakage of refrigerant gas in the indoor unit is detected while the air conditioner is driven in the state in which the aperture area of the passage toward at least one of the outlet ports is restricted to be small, the wind direction at an outlet port other than the at least one outlet port is changed downward. It is therefore possible to prevent the leaked refrigerant gas from locally stagnating at around the floor of the room space.

According to the fourth aspect of the invention, when leakage of refrigerant gas in the indoor unit is detected while the air conditioner is driven in the state in which the aperture area of the passage toward the lower outlet port out of the upper outlet port and the lower outlet port is restricted to be small, the aperture area of the passage toward the lower outlet port is enlarged. It is therefore possible to prevent the leaked refrigerant gas from locally stagnating at around the floor of the room space.

According to the fifth aspect of the invention, the air conditioner includes the floor-mounted indoor unit which is capable of preventing leaked refrigerant gas from locally stagnating at around the floor of the room space.

DESCRIPTION OF EMBODIMENTS

The following will describe an air conditioner according to an embodiment of the present invention, with reference to drawings.

[Overall Structure of Air Conditioner]

Figure 1:
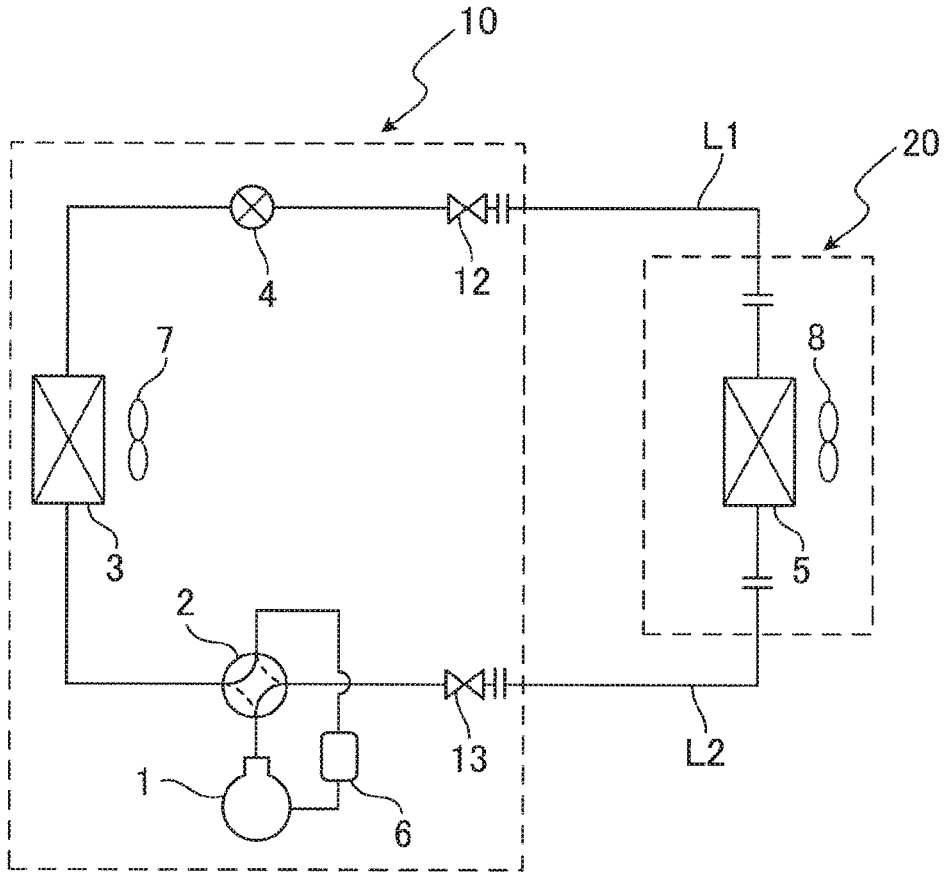
FIG. 1 is a circuit diagram showing a refrigerant circuit of an air conditioner of an embodiment of the present invention.

As shown in FIG. 1, an air conditioner of the present embodiment includes a compressor 1, a four-pass switching valve 2 having one end connected with the discharging side of the compressor 1, an outdoor heat exchanger 3 having one end connected with the other end of the four-pass switching valve 2, an electric expansion valve 4 having one end connected with the other end of the outdoor heat exchanger 3, an indoor heat exchanger 5 having one end connected with the other end of the electric expansion valve 4 via a stop valve 12 and a communication pipe L1, and an accumulator 6 having one end connected with the other end of the indoor heat exchanger 5 via a stop valve 13, a communication pipe L2, and the four-pass switching valve 2 and the other end connected with the sucking side of the compressor 1. The compressor 1, the four-pass switching valve 2, the outdoor heat exchanger 3, the electric expansion valve 4, the indoor heat exchanger 5, and the accumulator 6 form a refrigerant circuit.

In addition to the above, the air conditioner includes an outdoor fan 7 provided in the vicinity of the outdoor heat exchanger 3, and an indoor fan 8 provided in the vicinity of the indoor heat exchanger 5. The compressor 1, the four-pass switching valve 2, the outdoor heat exchanger 3, the electric expansion valve 4, the accumulator 6, and the outdoor fan 7 are provided in an outdoor unit 10, whereas the indoor heat exchanger 5 and the indoor fan 8 are provided in an indoor unit 20.

In this air conditioner, in a warming operation, as the four-pass switching valve 2 is switched to a position indicated by full lines and the compressor 1 is activated, high-pressure refrigerant discharged from the compressor 1 enters the indoor heat exchanger 5 through the four-pass switching valve 2. The refrigerant condensed in the indoor heat exchanger 5 is depressurized in the electric expansion valve 4 and then enters the outdoor heat exchanger 3. The refrigerant evaporated in the outdoor heat exchanger 3 returns to the sucking side of the compressor 1 via the four-pass switching valve 2 and the accumulator 6. In this way, a refrigerating cycle is formed such that the refrigerant circulates in the refrigerant circuit constituted by the compressor 1, the indoor heat exchanger 5, the electric expansion valve 4, the outdoor heat exchanger 3, and the accumulator 6. The room is warmed in such a way that room air is circulated by the indoor fan 8 through the indoor heat exchanger 5.

In the meanwhile, in a cooling operation (including a dehumidification operation), as the four-pass cooling operation 2 is switched to a position indicated by dotted lines and the compressor 1 is activated, high-pressure refrigerant discharged from the compressor 1 enters the outdoor heat exchanger 3 through the four-pass switching valve 2. The refrigerant condensed in the outdoor heat exchanger 3 is depressurized in the electric expansion valve 4 and then enters the indoor heat exchanger 5. The refrigerant evaporated in the indoor heat exchanger 5 returns to the sucking side of the compressor 1 via the four-pass switching valve 2 and the accumulator 6. In this way, a refrigerating cycle is formed such that the refrigerant circulates through the compressor 1, the outdoor heat exchanger 3, the electric expansion valve 4, the indoor heat exchanger 5, and the accumulator 6 in this order. The room is cooled in such a way that room air is circulated by the indoor fan 8 through the indoor heat exchanger 5.

This air conditioner uses flammable refrigerant. In the present invention, the term "flammable refrigerant" encompasses not only flammable refrigerant but also mildly flammable refrigerant. While the air conditioner uses R32 which is mildly flammable refrigerant, the air conditioner may use R290 , for example. The air conditioner uses refrigerant having a higher specific gravity than air.

[Indoor Unit]

Figure 2:
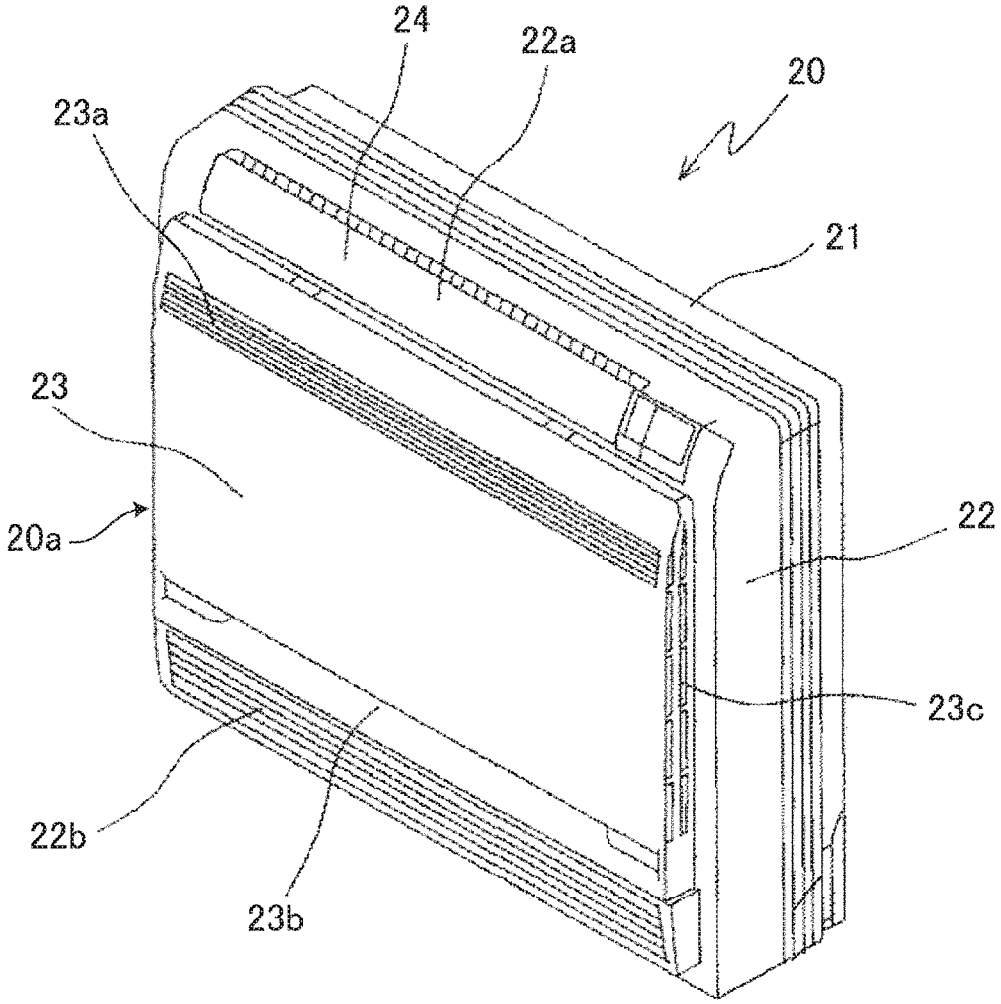
FIG. 2 is a perspective view of an indoor unit shown in FIG. 1.
Figure 3:
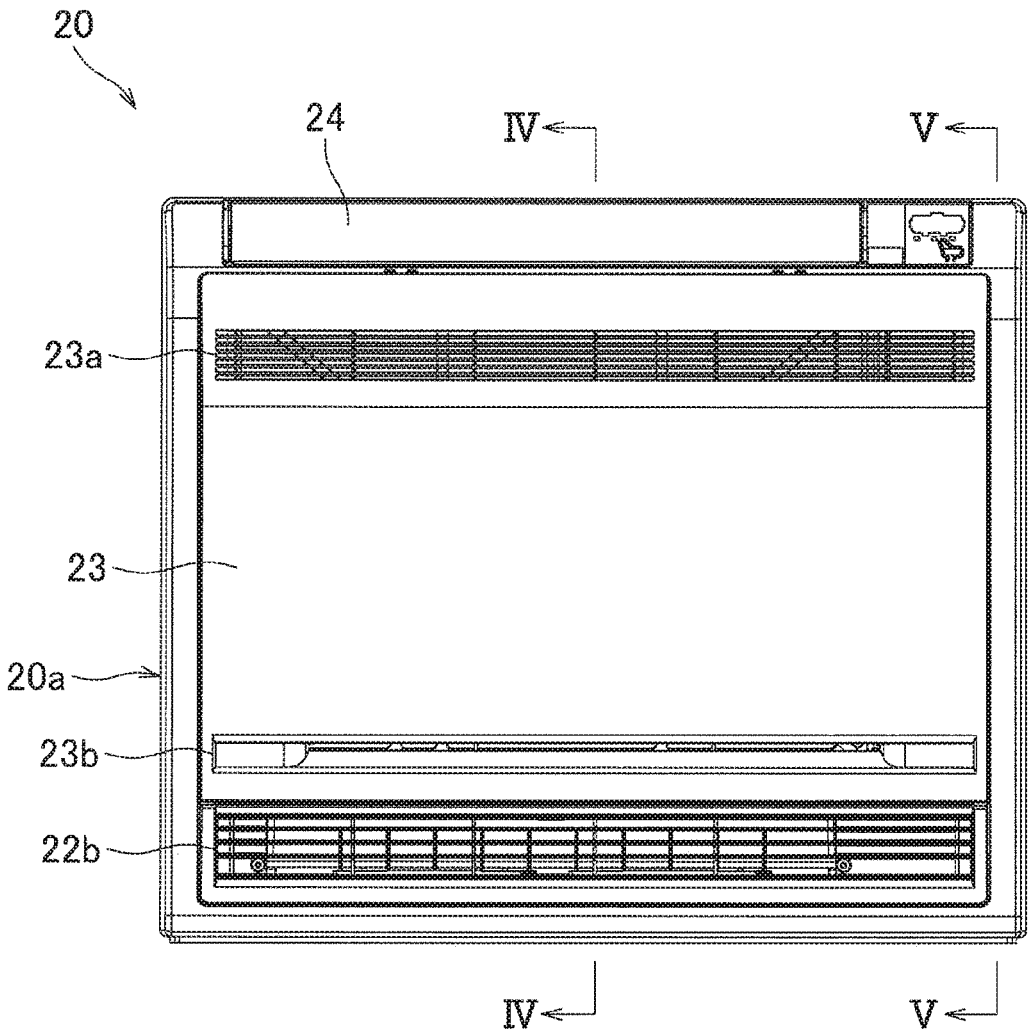
FIG. 3 is a front view of the indoor unit.
Figure 4:
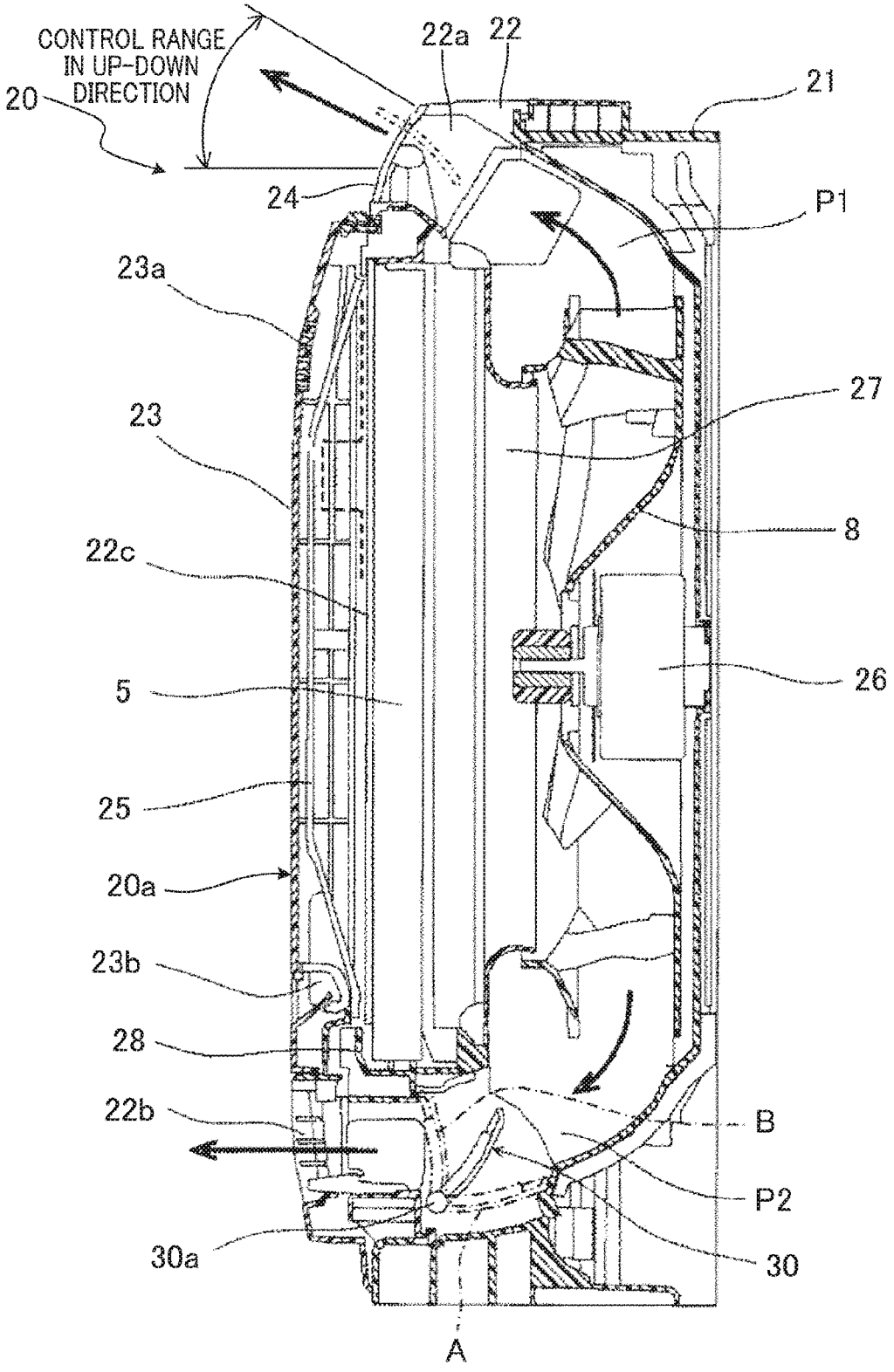
FIG. 4 is a cross section taken along the IV-IV line in FIG. 3.

As shown in FIG. 2 to FIG. 4, the indoor unit 20 is a floor-mounted indoor unit and includes a bottom frame 21 which is substantially rectangular in shape and is attached on the back surface side to a wall of the room, a front grill 22 which is attached to the front surface side of the bottom frame 21 and has a substantially rectangular opening 22*c* in the front surface, and a front panel 23 attached to cover the opening 22*c* of the front grill 22. The bottom frame 21, the front grill 22, and the front panel 23 form a casing 20*a*.

An upper outlet port 22*a* is formed at an upper part of the front grill 22, whereas a lower outlet port 22*b* is formed at a lower part of the front grill 22. In an upper outlet path P1 communicating with the upper outlet port 22*a*, a vertical flap 24 is provided to change, in the up-down direction, the direction of the air flow blown out from the upper outlet port 22*a*. The vertical flap 24 is connected with a flap motor 24*a* (see FIG. 7). The vertical flap 24 is rotatable about the rotational axis along the horizontal direction, by the driving of the flap motor 24*a*. During the cooling operation or the warming operation, this vertical flap 24 rotates within a vertical wind direction control range shown in FIG. 4 so that cool wind or warm wind is blown out forward and obliquely upward from the upper outlet port 22*a*. During the operation stop, the upper outlet port 22*a* is closed as shown in FIG. 2.

In the meanwhile, in a lower outlet path P2 communicating with the lower outlet port 22*b*, a shutter 30 configured to open and close the lower outlet port 22*b* and a horizontal flap 31 configured to change, in the left-right direction, the direction of the air flow blown out from the lower outlet port 22*b* are provided. The shutter 30 is connected with a shutter motor 30*b*. As shown in FIG. 4, the shutter 30 rotates about the axis 30*a* extending along the horizontal direction, by the driving of the shutter motor 30*b*. This shutter 30 stops at a position A indicated by a one dot chain line to open the lower outlet port 22*b*, and stops at a position B indicated by a one dot chain line to close the lower outlet port 22*b*. The direction of the horizontal flap 31 is manually adjusted.

An upper inlet port 23*a* is formed at an upper part of the front panel 23, a lower inlet port 23*b* is formed at a lower part of the front panel 23, and side inlet ports 23*c* (only the right one is shown in FIG. 2) are formed through side faces of the front panel 23.

As shown in FIG. 4, a fan motor 26 is fixed at a substantial center of the bottom frame 21. The indoor fan 8 connected with the axis of the fan motor 26 is disposed in the bottom frame 21 so that the axis of the fan extends along the front-back direction. The indoor fan 8 is a turbofan which sucks air from the front surface side and blows the air radially outward with respect to the axis. The bottom frame 21 includes a bell-mouth 27 formed on the front surface side of the indoor fan 8. The indoor heat exchanger 5 is provided on the front surface side of the bell-mouth 27, and the front grill 22 is attached to the front surface side of the indoor heat exchanger 5. Furthermore, the front panel 23 is attached to the front surface side of the front grill 22. To the opening 22*c* of the front grill 22, a filter 25 is attached.

As the driving of the air conditioner starts, the fan motor 26 is driven so that the indoor fan 8 rotates. As the indoor fan 8 rotates, room air is sucked into the indoor unit 20 through the upper inlet port 23*a*, the lower inlet port 23*b*, and the side inlet ports 23*c*. The room air sucked into the indoor unit 20 is subjected to the heat exchange by the indoor heat exchanger 5, and is then blown out to the room through the upper outlet port 22*a* and the lower outlet port 22*b*. When the lower outlet port 22*b* is closed by the shutter 30, the room air sucked into the indoor unit 20 is blown out only through the upper outlet port 22*a*.

In this way, in the air conditioner of the present embodiment, it is possible to open the passage toward the lower outlet port 22*b* by the shutter 30 to establish a blowout capable state in which wind is blown out from the lower outlet port 22*b*, and it is possible to close the passage toward the lower outlet port 22*b* by the shutter 30 to establish a blowout incapable state in which wind is not blown out from the lower outlet port 22*b*. The shutter 30 therefore functions as an adjusting mechanism which is provided on the passage toward the lower outlet port 22*b* to adjust the aperture area of the passage toward the lower outlet port 22*b*, and is configured to switch between the blowout capable state in which wind is blown out from the lower outlet port 22*b* and the blowout incapable state in which no wind is blown out from the lower outlet port 22*b*. In the present invention, the aperture area of the passage toward the lower outlet port 22*b* is considered to be 0 when the lower outlet port 22*b* is in the blowout incapable state, and after the lower outlet port 22*b* is switched from the blowout incapable state to the blowout capable state, the aperture area of the lower outlet port 22*b* is considered to be larger than 0 as the aperture area is increased. As such, the air conditioner of the present embodiment is arranged to operate in one of the following driving states: a driving state in which wind is blown out from the upper outlet port 22*a* and the lower outlet port 22*b*; and a driving state in which wind is blown out only from the upper outlet port 22*a* (i.e., no wind is blown out from the lower outlet port 22*b*).

Figure 5:
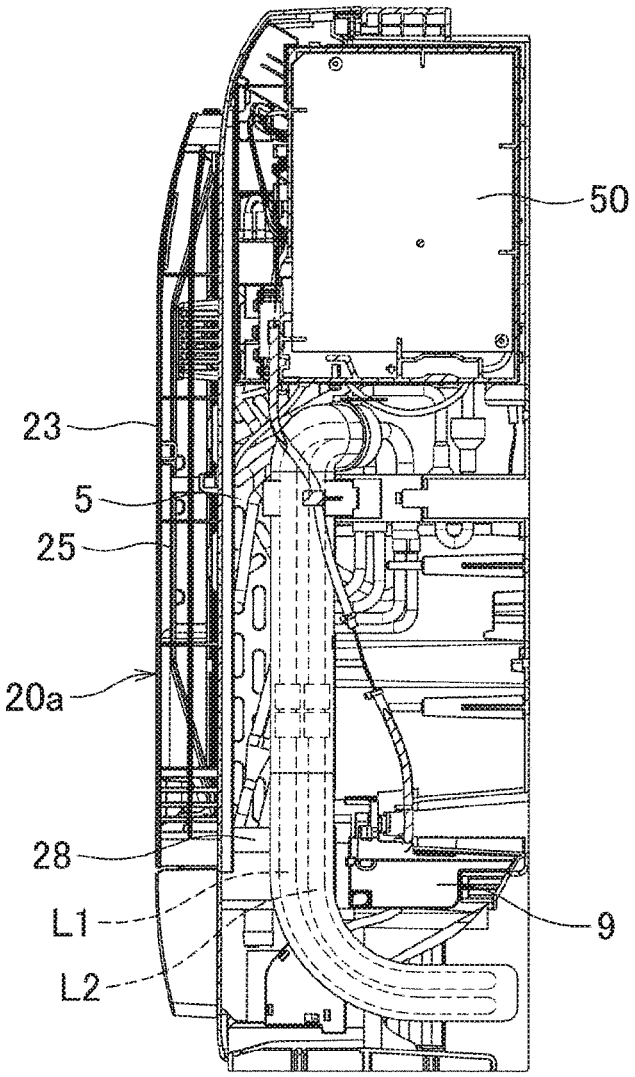
FIG. 5 is a cross section taken along the V-V line in FIG. 3.
Figure 6:
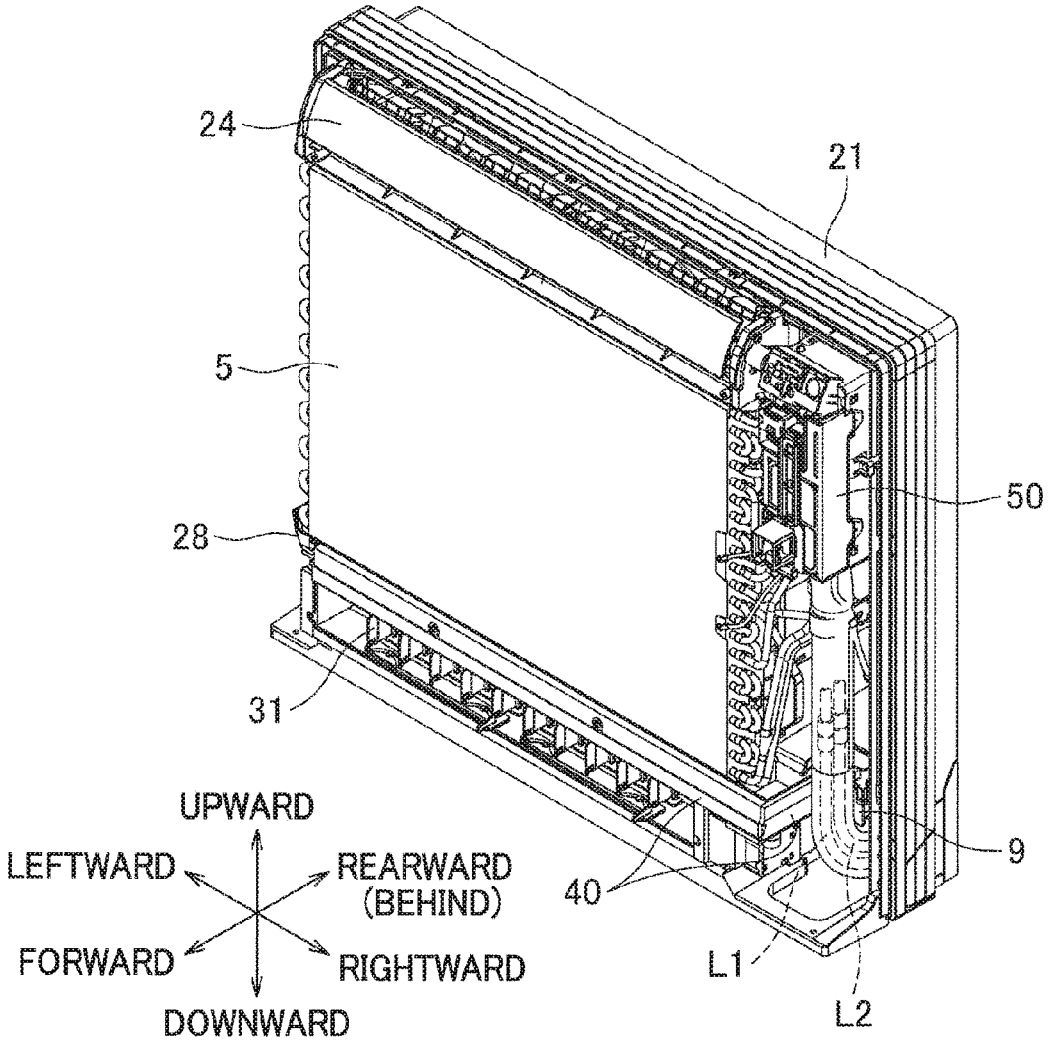
FIG. 6 is a perspective view of the indoor unit from which a front panel has been detached.

As shown in FIG. 5 and FIG. 6, a drain pan 28 is provided below the indoor heat exchanger 5 to receive and drain the condensed water from the air, which is generated on the indoor heat exchanger 5. Furthermore, an electronic component box 50 is provided to the right of (outside in the longitudinal direction) and above the indoor heat exchanger 5. Below the electronic component box 50, a refrigerant gas sensor 9 is detachably attached. This refrigerant gas sensor 9 is provided to the right of (outside in the longitudinal direction) the indoor heat exchanger 5 and the drain pan 28.

In this air conditioner, when refrigerant gas accidentally leaks out due to a reason such as the breakage of a refrigerant pipe in the indoor heat exchanger 5, the refrigerant gas having the higher specific gravity than air flows downward and reaches the drain pan 28. The refrigerant gas having reached the drain pan 28 flows from the left end side toward the right end side of the drain pan 28. On this account, the refrigerant gas having reached the drain pan 28 tends to overflow the drain pan 28 from the refrigerant gas sensor 9 side in the longitudinal direction. The overflow refrigerant gas stagnates at the bottom of the indoor unit 20, and leaks out of the indoor unit 20.

(Electronic Component Box)

Figure 7:
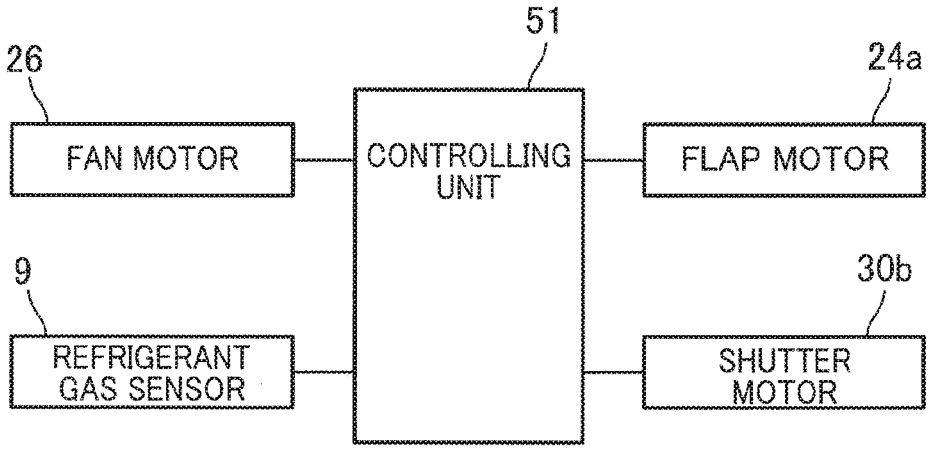
FIG. 7 shows a control block of the indoor unit.

The electronic component box 50 houses a controlling unit 51 therein for controlling components required for operations such as the cooling and warming operations of the air conditioner. As shown in FIG. 7, this controlling unit 51 is connected with the fan motor 26, the refrigerant gas sensor 9, the flap motor 24*a*, and the shutter motor 30*b*, controls the indoor fan 8, the vertical flap 24, and the shutter 30, and determines whether refrigerant leakage occurs based on a result of detection of the refrigerant gas by the refrigerant gas sensor 9.

(Refrigerant Gas Sensor)

The refrigerant gas sensor 9 is a sensor configured to detect leaked refrigerant gas, and is provided to be flush with or lower than the drain pan 28 as shown in FIG. 5. The refrigerant gas sensor is provided to the right of (outside in the longitudinal direction) the drain pan 28 and to be away from (i.e., behind) the drain pan 28 and the indoor heat exchanger 5.

Figure 8:
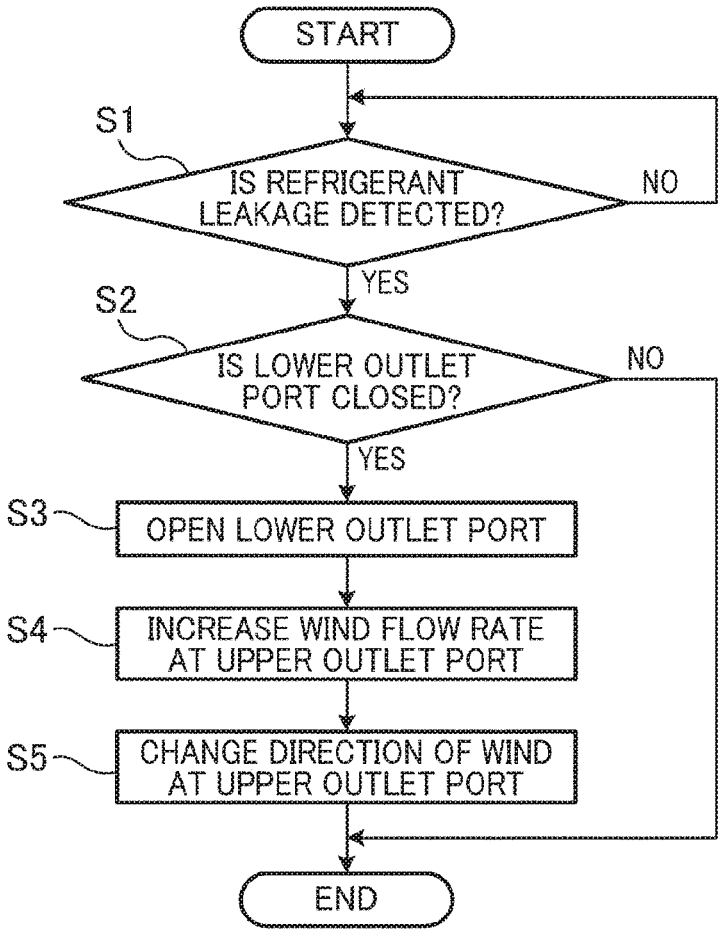
FIG. 8 is a flowchart showing processes executed when leakage of refrigerant gas is detected.

With reference to FIG. 8, the following will describe an operation executed when leakage of refrigerant gas is detected in the air conditioner of the present embodiment.

To begin with, whether refrigerant leakage has occurred is repeatedly determined based on results of detection of the refrigerant gas by the refrigerant gas sensor 9 (step S1). When the refrigerant leakage is detected (S1: YES), whether the driving state in which wind is blown out only from the upper outlet port 22*a* (i.e., the driving state in which no wind is blown out from the lower outlet port 22*b*) is set is determined (step S2).

When it is determined that the driving state in which wind is blown out only from the upper outlet port 22*a* is set (S2: YES), the flap motor 24*a* is controlled to move the shutter 30. Therefore the lower outlet port 22*b* is switched from the blowout incapable state in which no wind is blown out from the lower outlet port 22*b* to the blowout capable state in which wind is blown out from the lower outlet port 22*b* (step S3). The air conditioner becomes in the driving state in which wind is blown out from the upper outlet port 22*a* and the lower outlet port 22*b*.

In this state, the rotation number of the fan motor 26 with which the indoor fan 8 is connected is controlled to increase so that the wind flow rate at the upper outlet port 22*a* is increased as compared to the wind flow rate before the determination that the refrigerant leakage has occurred (step S4). Furthermore, the flap motor 24*a* connected with the vertical flap 24 is controlled to cause the vertical flap 24 to change the wind direction downward so that the wind direction at the upper outlet port 22*a* is lower than the wind direction before the determination that the refrigerant leakage has occurred (step S5).

[Characteristics of Air Conditioner of Present Embodiment]

The air conditioner of the present embodiment has the following characteristics.

In the air conditioner of the present embodiment, when refrigerant gas leaks in the indoor unit while the air conditioner is driven in the state that the lower outlet port 22*b* out of the upper outlet port 22*a* and the lower outlet port 22*b* is closed, the state in which the lower outlet port 22*b* is closed is switched to the state in which the port is not closed. It is therefore possible to effectively prevent the leaked refrigerant gas from locally stagnating at around the floor of the room space.

In the air conditioner of the present embodiment, when refrigerant gas leaks in the indoor unit while the air conditioner is driven in the state that the lower outlet port 22*b* out of the upper outlet port 22*a* and the lower outlet port 22*b* is closed, the wind flow rate is increased at the upper outlet port 22*a*. It is therefore possible to effectively prevent the leaked refrigerant gas from locally stagnating at a part of the room space.

In the air conditioner of the present embodiment, when refrigerant gas leaks in the indoor unit while the air conditioner is driven in the state that the lower outlet port 22*b* out of the upper outlet port 22*a* and the lower outlet port 22*b* is closed, the wind direction at the upper outlet port 22*a* is changed downward. It is therefore possible to effectively prevent the leaked refrigerant gas from locally stagnating at around the floor of the room space.

Thus, the embodiments of the present invention have been described hereinabove. However, the specific structure of the present invention shall not be interpreted as to be limited to the above described embodiments. The scope of the present invention is defined not by the above embodiments but by claims set forth below, and shall encompass the equivalents in the meaning of the claims and every modification within the scope of the claims.

The embodiment above relates to the air conditioner having the indoor unit with two outlet ports, and describes that, when leakage of refrigerant gas is detected in the driving state in which one of the outlet ports is closed, the state in which one of the outlet ports is closed is switched to the state in which the one of the outlet ports is not closed. In this regard, the number of the outlet ports of the indoor unit may be different. The effects of the present invention can be achieved in an air conditioner having an indoor unit with plural outlet ports, in which, when leakage of refrigerant gas is detected in the driving state in which at least one of the outlet ports is closed, the state in which one or more of the at least one of the outlet ports is closed is switched to the state in which the one or more of the at least one of the outlet ports is not closed. Therefore, when leakage of refrigerant gas is detected in the driving state in which at least one of the outlet ports is closed, the state in which the at least one of the outlet port is closed may be switched from the state in which all of the at least one of the outlet ports is closed to the state in which all of the at least one of the outlet ports is not closed, or the state in which one or more of the at least one of the outlet ports is closed may be switched to the state in which the one or more of the at least one of the outlet ports is not closed.

The embodiment above relates to the air conditioner having the indoor unit with two outlet ports, and describes that, when leakage of refrigerant gas is detected in the driving state in which one of the outlet ports is closed, the state in which one of the outlet ports is closed is switched to the state in which none of the outlet ports is closed. In this regard, when the leakage of the refrigerant gas is detected in the driving state in which the aperture area of the passage toward one of the two outlet ports is restricted to be small, the aperture area of this passage toward the one of the outlet ports may be increased. In the present invention, increase in the aperture area of the passage toward the outlet port indicates increase in the aperture area of the passage toward the outlet port is carried out by the controlling unit so that the wind flow rate blown out from that outlet port increases without increasing the rotation number of the indoor fan. Therefore, when leakage of refrigerant gas is detected in the air conditioner including the indoor unit having plural outlet ports, in which the aperture area of the passage toward at least one of the outlet ports is restricted to be small, the aperture area of the passage toward one or more of the at least one of the outlet ports may be enlarged. For this reason, the adjusting mechanism is not limited to the mechanism configured to switch between the blowout capable state in which wind is blown out from the outlet port and the blowout incapable state in which no wind is blown out from the outlet port, and may be configured to adjust the aperture area of the passage toward the outlet port.

While in the embodiment above the adjusting mechanism which is configured to switch between the blowout capable state in which wind is blown out from the outlet port and the blowout incapable state in which no wind is blown out from the outlet port is provided only for the lower outlet port out of the upper outlet port and the lower outlet port of the indoor unit, the adjusting mechanism may be provided for each of all the outlet ports. The present invention therefore encompasses an arrangement in which the indoor unit has plural outlet ports and an adjusting mechanism is provided for at least one of the outlet ports.

The embodiment above relates to the air conditioner having the indoor unit with two outlet ports, and describes that, when leakage of refrigerant gas is detected in the driving state in which one of the outlet ports is closed, the wind flow rate at the outlet port other than that one of the outlet ports is increased and the wind direction is changed downward. Alternatively, the wind flow rate at the outlet port other than that one of the outlet ports may not be increased, and the wind direction may not be changed downward.

While in the embodiment above the indoor unit is a floor-mounted indoor unit, the indoor unit may not be floor-mounted, and may be wall-mounted.

INDUSTRIAL APPLICABILITY

The present invention makes it possible to prevent leaked refrigerant gas from disadvantageously stagnating locally at a part of a room space.

REFERENCE SIGNS LIST

9: refrigerant gas sensor
20: indoor unit
20*a*: casing
22*a*: upper outlet port (outlet port)
22*b*: lower outlet port (outlet port)
30: shutter (adjusting mechanism)
51: controlling unit (controlling unit)

The invention claimed is:

1. An air conditioner which comprises an indoor unit having plural outlet ports including a first outlet port and a second outlet port for blowing air into an interior room space and uses flammable refrigerant, plural passages toward the respective outlet ports being formed in the indoor unit, the plural passages including a first passage toward the first outlet port and a second passage toward the second outlet port, the air conditioner further comprising:

an adjusting mechanism which is provided on the first passage and is configured to adjust an aperture area of the first passage;

a refrigerant gas sensor provided in the indoor unit; and a controlling unit configured to control the adjusting mechanism, such that during a driving state, in which air with a first wind flow rate is blown out from the first outlet port into the interior room space as the adjusting mechanism restricts the aperture area and air with a second wind flow rate larger than the first wind flow rate is blown out from the second outlet port into the interior room space, when the refrigerant gas sensor detects refrigerant gas, the controlling unit increases the aperture area.

2. The air conditioner according to claim 1, wherein, the controlling unit is further configured to increase a wind flow rate of the air blown out from the first outlet port, when the refrigerant gas sensor detects the refrigerant gas.

3. The air conditioner according to claim 1, wherein, the controlling unit is further configured to change a direction of the air blown out from the first outlet port downward, when the refrigerant gas sensor detects the refrigerant gas.

4. The air conditioner according to claim 1, wherein, the second outlet port is an upper outlet port provided at an upper end portion of a casing and the first outlet port is a lower outlet port provided below the upper end portion.

5. The air conditioner according to claim 1, wherein, the indoor unit is a floor-mounted indoor unit.

* * * * *